United States Patent [19]

Inoguchi et al.

[11] Patent Number: 4,676,204

[45] Date of Patent: Jun. 30, 1987

[54] STARTING SYSTEM OF AN INTERNAL COMBUSTION ENGINE

[75] Inventors: Kenichi Inoguchi; Yoichi Iwakura, both of Oosaka; Hirofumi Tanaka, Nishinomiya; Jun Umehara, Oobu, all of Japan

[73] Assignees: Daihatsu Motor Co. Ltd., Oosaka; Aisan Kogyo Kabushiki Kaisha, Aichi, both of Japan

[21] Appl. No.: 812,987

[22] Filed: Dec. 24, 1985

[30] Foreign Application Priority Data

Dec. 29, 1984 [JP] Japan ..... 59-276068

[51] Int. Cl.[4] ..... F02M 1/08

[52] U.S. Cl. ..... 123/179 G; 123/179 A; 123/180 P; 123/339; 123/438

[58] Field of Search ..... 123/438, 491, 179 G, 123/179 L, 180 E, 180 P, 339, 179 A

[56] References Cited

U.S. PATENT DOCUMENTS 4,184,460 1/1980 Harada et al. ..... 123/491
4,249,496 2/1981 Shimazaki et al. ..... 123/438
4,383,506 5/1983 Atago et al. ..... 123/179 G
4,441,467 4/1984 Powell ..... 123/179 G
4,480,618 11/1984 Kamifuji et al. ..... 123/438

FOREIGN PATENT DOCUMENTS 3105835 9/1982 Fed. Rep. of Germany .
3320401 12/1983 Fed. Rep. of Germany .
59-32648 2/1984 Japan ..... 123/179 G

*Primary Examiner*—Andrew M. Dolinar
*Attorney, Agent, or Firm*—Sixbey, Friedman & Leedom

[57] ABSTRACT

A starting system of an engine according to the present invention comprises an electromagnetically-operated fuel resupply pump for supplying auxiliary fuel to an intake passage of the engine, and various detectors for detecting the operating conditions of the engine, e.g., engine speed, temperature of engine cooling water, drive of a starting motor, etc., and a control circuit for controlling the drive of the fuel resupply pump in accordance with signals from the detectors. The control circuit is partially formed of a microcomputer, which controls the pump so that a pulse voltage is applied to a solenoid of the pump for a longer time when the engine is in a cranking state than when the engine is in any other operating state.

9 Claims, 9 Drawing Figures

STARTING SYSTEM OF AN INTERNAL COMBUSTION ENGINE

BACKGROUND OF THE INVENTION

The present invention relates to a starting system adapted for use with a car engine, especially a gasoline engine of an automobile.

For smoother starting of a gasoline engine at a low temperature, a richer air-fuel mixture should be supplied to combustion chambers of the engine. Therefore, a carburetor for supplying the air-fuel mixture to the combustion chambers is provided with a choke valve in the vicinity of its intake portion. The choke valve serves to constrict an air intake passage in the carburetor, thereby reducing the quantity of air fed into the combustion chambers of the engine. Thus, a rich air-fuel mixture can be fed into the combustion chambers by operating the choke valve.

The choke valve may be switched by manual or automatic remote control. When remotely operating the valve, however, it must be mechanically coupled to a manual control knob or an actuator by means of a linkage or the like. Accordingly, the mechanical arrangement surrounding the carburetor is complicated.

Instead of using the choke valve to throttle the flow of air in the intake passage, an electrically-operated fuel resupply pump may be used to supply auxiliary fuel to the intake passage. In this case, the amount of fuel supplied to the intake passage is increased by the pump. Thus, as in the aforesaid case, a rich air-fuel mixture can be fed into the combustion chambers of the engine, improving the starting performance of the engine.

For the fuel resupply pump, a plunger-type electromagnetic pump may be used which comprises a plunger for pumping action and a solenoid for reciprocating the plunger in cooperation with a return spring. The quantity of auxiliary fuel delivered from this pump per unit time may easily be changed by varying the period of a pulse voltage applied to the solenoid. Thus, the starting performance of the engine is improved, and a necessary quantity of fuel can be supplied to the intake passage of the carburetor in accordance with the operating state of the engine.

According to this arrangement, a predetermined quantity of auxiliary fuel can be accurately delivered from the fuel resupply pump when the engine is in any other operating state than a starting mode. When the engine is in the starting mode or cranking state such that it is externally rotated by a starting motor, however, the pump sometimes cannot supply the intake passage of the carburetor with the necessary quantity of auxiliary fuel for the cranking state. This is because if the starting motor is actuated when the battery voltage of the engine is not high enough, the battery voltage is greatly lowered to cause a substantial drop of the pulse voltage applied to the solenoid of the fuel resupply pump. More specifically, if the pulse voltage, even with a constant period, is lowered, the electromagnetic force of attraction of the plunger produced by the solenoid is reduced. As a result, the action of the plunger against the urging force of the return spring is subject to a response time lag, so that the plunger cannot enjoy a satisfactory stroke.

Thus, in some cases, the fuel resupply pump cannot provide the necessary quantity of fuel for the starting of the engine which may possibly cause a drop of the pulse voltage supplied to the solenoid. In other words, the engine cannot maintain a reliable starting performance.

SUMMARY OF THE INVENTION

The object of the present invention is to provide a starting system of an engine using an electromagnetically-operated fuel resupply pump and ensuring improved starting performance of the engine.

In order to achieve the above object, a starting system of an engine according to the present invention comprises a carburetor housing having an air intake passage defined inside, an electromagnetically-operated fuel resupply pump for feeding auxiliary fuel into the intake passage of the carburetor housing, the fuel resupply pump including a plunger and a solenoid for reciprocating the plunger in cooperation with a return spring, and adapted to effect a pumping function such that the plunger is reciprocated for one stroke every time a pulse voltage is applied to the solenoid for a predetermined impression time, operating state detecting means for determining whether the engine is stopped, or in a cranking state, or in a complete detonation state such that the engine can maintain its rotation for itself, drive means for driving the fuel resupply pump by applying a pulse voltage with a predetermined period to the solenoid of the pump for a predetermined impression time, and control means for controlling the drive of the fuel resupply pump by the drive means, the control means including a period decision circuit for determining the period of the pulse voltage applied to the solenoid of the pump, in accordance with the operating state of the engine detected by the operating state detecting means, and a pulse width correction circuit for a correction such that the impression time for the pulse voltage applied to the solenoid of the fuel resupply pump is longer when the engine is in the cranking state than when the engine is in any other operating state.

According to starting system of the present invention, the impression time for the pulse voltage applied to the solenoid of the fuel resupply pump is made longer when the engine is in the cranking state, which involves a drop of the pulse voltage, than when the engine is in any other operating state. By doing this, the pump can be driven efficiently. If the pulse voltage applied to the solenoid is lowered, therefore, the stroke of the plunger can satisfactorily be maintained by extending the impression time despite a response time lag of plunger action. Thus, even when the engine is in the cranking state, a necessary quantity of auxiliary fuel can securely be supplied from the fuel resupply pump to the intake passage of the carburetor, positively ensuring a good starting of the engine.

As described above, moreover, the impression time for the pulse voltage applied to the solenoid of the fuel resupply pump is extended only when the engine is in the cranking state. If the engine is in any other operating state, e.g., if the battery voltage of the engine is high enough for a sufficient pulse voltage to be applied to the solenoid, therefore, the impression time is made shorter than that for the cranking state, depending on the operating conditions of the engine. Accordingly, wrong operations of the pump can be prevented despite the extension of the impression time. Meanwhile, if a high enough pulse voltage is applied to the solenoid for a long time, the plunger bears increased residual magnetism and is prevented thereby from being satisfactorily returned by the return spring. Just as in case of a pulse voltage drop, therefore, the quantity of auxiliary fuel delivered from the fuel resupply pump is reduced. Thus, according to the starting system of the invention constructed in the aforesaid manner, the engine can always be started with high reliability, and a necessary quantity of auxiliary fuel for the engine can accurately be supplied after the engine is started.

DETAILED DESCRIPTION OF THE PREFERRED EMBODIMENTS

Figure 1:
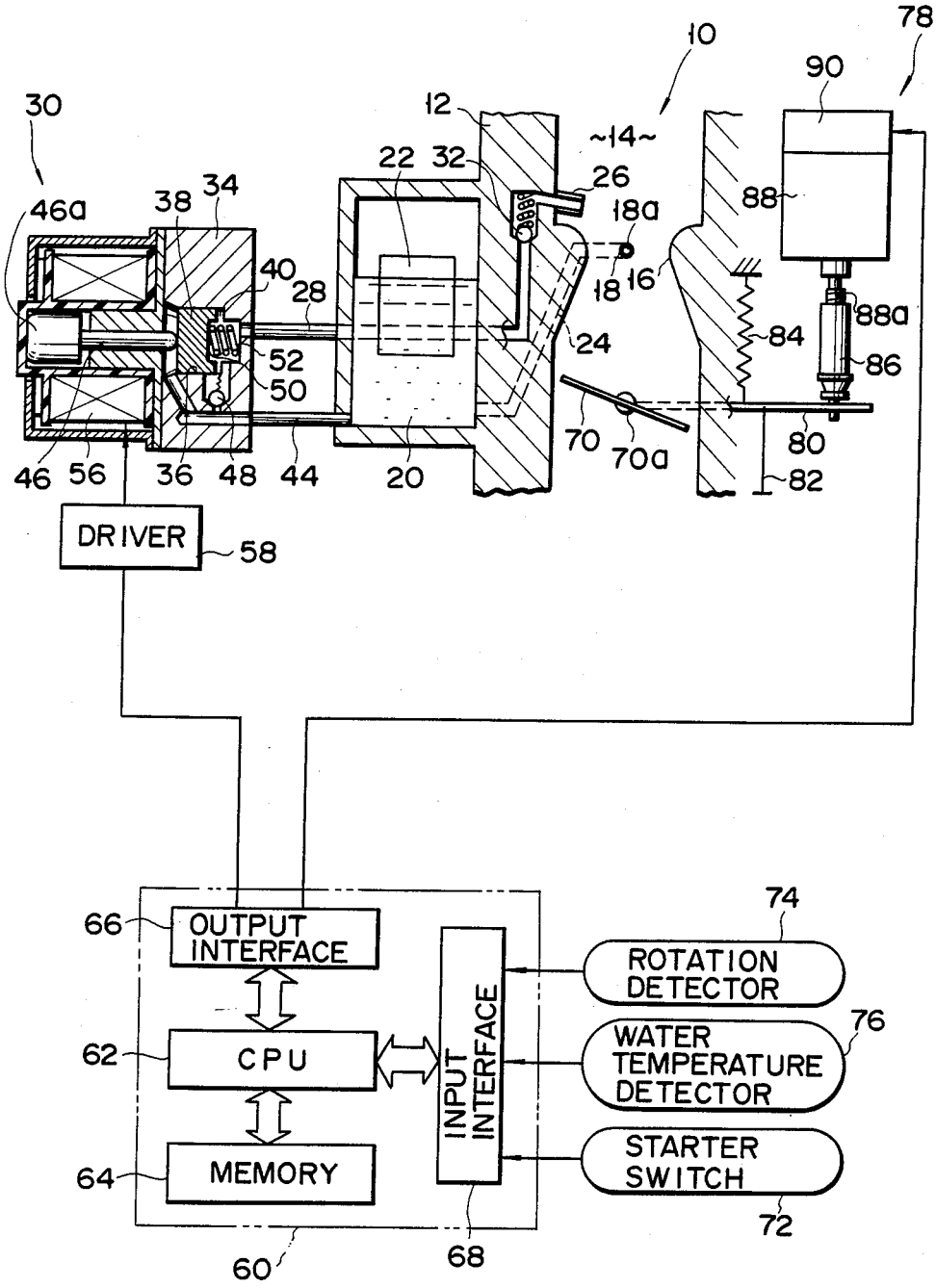
FIG. 1 is a schematic view of a starting system according to an embodiment of the present invention.

Referring now to FIG. 1, there is schematically shown a starting system of a gasoline engine for an automobile according to the present invention. The starting system is provided with carburetor 10. In FIG. 1, carburetor 10 is shown only partially. Carburetor 10 has housing 12 in which air intake passage 14 is defined. Passage 14 is connected at one end to an air cleaner for introducing the outside air. The other end of passage 14 is connected to a plurality of combustion chambers of the engine by means of an intake manifold (not shown). The air cleaner, manifold, and engine are not shown in FIG. 1.

Venturi portion 16 for reducing the cross-sectional area of intake passage 14 is formed in the middle of passage 14. Main nozzle 18 projects into portion 16.

Independent of intake passage 14, float chamber 20 is defined in housing 12. Fuel is stored in chamber 20. Float 22 is floated on the surface of the fuel. Float 22 serves to maintain an predetermined surface level of the fuel in chamber 20. A fuel port (not shown) of float chamber 20 is connected to a fuel supply pump (not shown). Disposed in the fuel port is a needle valve (not shown) which is adapted to open and close the port as float 22 moves up and down. Float chamber 20 is connected to nozzle 18 by means of passage 24 indicated by broken lines in FIG. 1. Thus, the fuel in chamber 20 is continually fed to port 18*a* of nozzle 18.

Auxiliary nozzle 26 projects into intake passage 14, located close to and on the upper-course side of main nozzle 18. Nozzle 26 is connected to fuel resupply pump 30 by means of fuel delivery pipe 28. Pipe 28 is provided with check valve 32 for preventing the fuel from flowing from nozzle 26 to pump 30.

Resupply pump 30 is a plunger pump which is operated electromagnetically. Pump 30 has pump housing 34 in which cylinder chamber 36 is defined. A plunger 38 is slidably fitted in cylinder chamber 38. Pump chamber 40 is defined between the end face of plunger 38 and the inner end face of chamber 36 opposed thereto. Chamber 40 is connected to fuel delivery passage 28 on one side, and to float chamber 20 via suction passage 44 on the other side. Passage 44 is provided with check valve 48 for preventing the fuel from flowing from pump chamber 40 to float chamber 20.

Recess 50 is formed in one end face of plunger 38. Return coil spring 52 is interposed between the inner end face of recess 50 and the inner end face of cylinder chamber 36 defining pump chamber 40. Spring 52 urges plunger 38 in a direction to increase the capacity of chamber 40. One end of sliding rod 46 abuts against the other end face of plunger 38. Sliding rod 46 can slide along the same axis with plunger 38 inside pump housing 34. The other end of rod 46, which projects from housing 34, is formed integrally with large-diameter portion. Rod 46 and portion 46*a* are surrounded by solenoid 56, which is electrically connected to driver 58 for applying pulse voltage to solenoid 56. Driver 58 serves to apply the pulse voltage with a predetermined period to solenoid 56 for a predetermined time. If the pulse voltage from driver 58 is applied to solenoid 56 with predetermined pulse period F, solenoid 56 intermittently produces an electromagnetic force to cause sliding rod 46 to be attracted to plunger 38. As a result, plunger 38 is reciprocated by the electromagnetic force and the urging force of return spring 52, thereby effecting a pumping function. Thus, plunger 38 is reciprocated in accordance with period F of the pulse voltage, so that the fuel supplied from float chamber 20 to pump chamber 40 is pulsatively injected, by a fixed amount (e.g., 0.04 cc) at a time, from auxiliary nozzle 26 into air intake passage 14 of carburetor 10 through fuel delivery passage 28. Thus, according to fuel resupply pump 30 constructed in this manner, the amount of fuel delivered from pump 30 per unit time, i.e., the amount of fuel injected from nozzle 26, can be increased by shortening period F of the pulse voltage applied to solenoid 56. By lengthening period F, on the other hand, the injection quantity can be reduced.

Driver 58 is electrically connected to microcomputer 60 as a control circuit for controlling the drive of fuel resupply pump 30. Microcomputer 60 includes central processing unit (CPU) 62, memory 64 connected to CPU 62, output interface 66 for connecting CPU 62 and driver 58, and input interface 68 connecting CPU 62 and various detectors mentioned later.

Input interface 68 is supplied with detection signals from rotation detector 74, water temperature detector 76, and starter switch 72. Detector 74 detects the engine speed, while detector 76 detects the temperature of cooling water of the engine.

Rotation detector 74 detects the rotational frequency of the engine from, e.g., the frequency of pulse voltage applied to an ignition coil (not shown) of the engine, and delivers a rotation signal corresponding to the rotational frequency to input interface 68. Water temperature detector 76 includes, for example, a thermistor (not shown) for converting the cooling water temperature into an analog electric signal, and an analog-to-digital converter (not shown) for converting the output of the thermistor into a digital electric signal and applying cooling water temperature signal T to interface 68. Starter switch 72 serves to actuate a starting motor (not shown) for the engine.

Output interface 66 of microcomputer 60 is electrically connected not only to driver 58 but also to regulator 78 for adjusting the opening of throttle valve 70, as shown in FIG. 1. Inside intake passage 14, throttle valve 70 is mounted on rotating shaft 70*a*, located on the lower-course side of venturi portion 16. One end of rocking arm 80 is attached to shaft 70*a*. Arm 80 extends at right angles to shaft 70*a*, and its other end projects outward from housing 12 of carburetor 10. One end of wire 82 is connected to the projecting end of arm 80. The other end of wire 82 is connected to an accelerator pedal (not shown) of the automobile by means of a link mechanism (not shown). Also, urging spring 84 is coupled to the projecting end of rocking arm 80. Spring 84 urges arm 82 to rock so that valve 70 is closed as shown in FIG. 1. When the accelerator pedal is worked, arm 80 is rocked by wire 82 against the urging force of spring 84, so that valve 70 is opened.

Regulator 78 includes nut member 86 which engages rocking arm 80 so as to allow throttle valve 70 to be opened and is prevented from rotating by a guide (not shown), DC motor 88 having feed screw portion 88*a* as its output shaft screwed in member 86, and driver 90 for pulsatively applying DC voltage to motor 88 to drive the same.

Microcomputer 60 logically processes the detection signals supplied from the detectors to input interface 68, and delivers a control signal for controlling the drive of fuel resupply pump 30, that is, a signal for determining pulse period F and impression time of the pulse voltage applied from driver 58 to solenoid 56 of pump 30, and a control signal for controlling the operation of regulator 78, to their corresponding drivers 58 and 90 through output interface 66. Microcomputer 60 is stored with a program for controlling the operations of pump 30 and regulator 78 in accordance with the flow charts of FIGS. 2A and 2B. Referring now to FIGS. 2A to 8, the operation of the starting system of the present invention will be described.

Figure 2A:
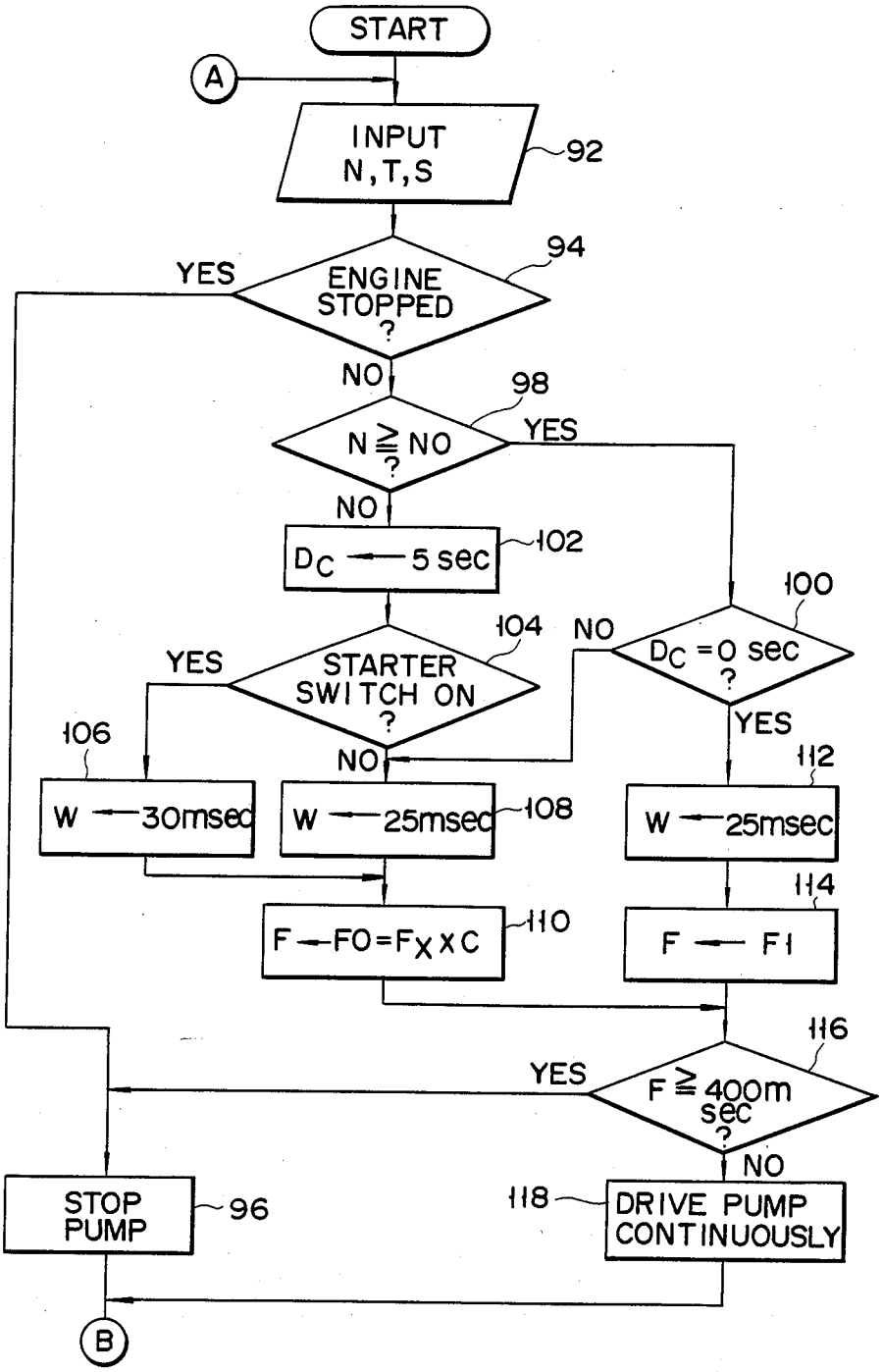
FIGS. 2A and 2B are flow charts for illustrating the operation of a control circuit used in the starting system of FIG. 1.

In step 92 shown in FIG. 2A, input interface 68 of microcomputer 60 is supplied with rotation Signal N from rotation detector 74 responsive to the rotational frequency of the engine, cooling water temperature signal T from water temperature detector 76, and ON or OFF signal Sl or S2 from starter switch 72. Then, in step 94, whether the engine is stopped or not is determined by rotation signal N. If the engine is found to be stopped in step 94, step 96 is entered. If not, that is, if the engine is found to be rotating, step 98 is entered. In step 96, the drive of fuel resupply pump 30 is stopped.

In step 98, whether or not the level of rotation signal N is equal to or higher than complete-detonation reference value $N_O$ of the engine is determined. Reference value $N_O$ serves as a criterion for determining whether the engine is being externally rotated by the starting motor (not shown), that is, in a cranking state, or whether the engine is rotating unaided, that is, in a complete detonation state. For example, reference value $N_O$ is adjusted to a value corresponding to the rotational frequency of the engine ranging from 440 rpm to 800 rpm. If it is concluded in step 98 that the level of rotation signal N is not less than reference value $N_O$, that is, the engine is undergoing complete detonation, step 100 is entered. If the level of signal N is found to be less than value $N_O$, that is, if the engine is in the cranking state, step 102 is entered.

Figure 6:
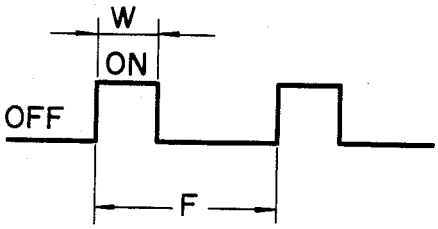
FIG. 6 is a diagram for illustrating conditions for pulse voltage impression.

In step 102, 5 sec is set as an initial value in subtraction counter Dc which is incorporated in CPU 62, and step 104 is then entered. In step 104, whether the starting motor is being driven or not is determined in accordance with the signal from starter switch 72. If it is concluded in step 104 that the starting motor is in operation, that is, the engine is in the cranking state, step 106 is entered. If the motor is determined to be stopped, on the other hand, step 108 is entered. In step 106, impression time W for the pulse voltage applied to solenoid 56 of fuel resupply pump 30 is adjusted to 30 msec, as shown in FIG. 6, and step 110 is entered. In step 108, time W is adjusted to 25 msec, and step 110 is entered.

Figure 3:
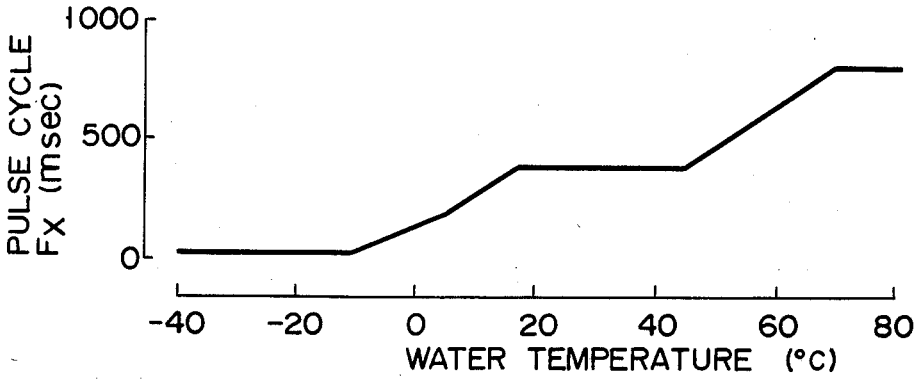
FIGS. 3 to 5 are diagrams for illustrating several criteria used in the control circuit.
Figure 4:
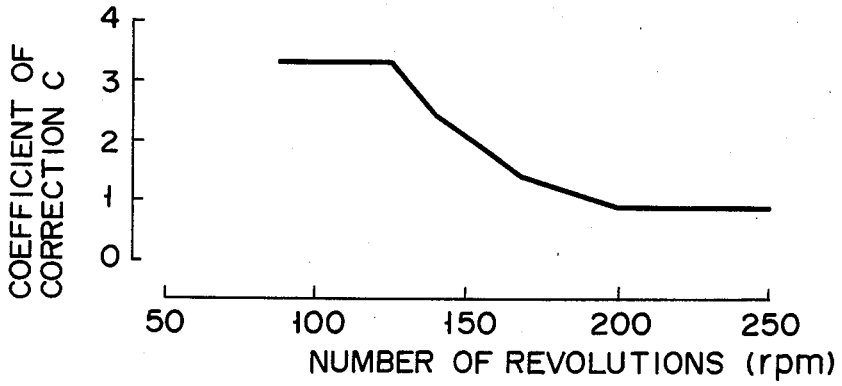

In step 110, pulse period F of the pulse voltage applied to solenoid 56 of fuel resupply pump 30 is adjusted to $F_O$. Value $F_O$ is a value which is obtained by multiplying optimum pulse period $F_X$ for cranking by coefficient of correction C, that is, $F_O = F_X \times C$. Period $F_X$ depends on the cooling water temperature of the engine as a parameter, as shown in FIG. 3. In other words, period $F_X$ for cranking is determined so that air intake passage 14 of carburetor 10 is supplied, from pump 30 through auxiliary nozzle 26, with auxiliary fuel necessary for the engine to quickly shift from cranking state to complete detonation. Also, optimum period $F_X$ corresponding to the cooling water temperature is mapped and stored in memory 64 of microcomputer 60. Coefficient of correction C is used in correcting irregularity of the air-fuel ratio attributed to variations of the rotational frequency of the engine in the cranking state. The value of coefficient C is obtained with use of the engine speed as a parameter, as shown in FIG. 4, and is also mapped and stored in memory 64 of microcomputer 60. Thus, in microcomputer 60, pulse period $F_X$ and coefficient of correction C for cranking are calculated on the basis of rotation signal N and water temperature signal T inputted in step 90. The value of pulse period $F_O$ for the drive of fuel resupply pump 30 is determined by these values. Thereupon, a signal for energizing solenoid 56 of pump 30 is delivered from output interface 66 of microcomputer 60 to driver 58, so that a pulse voltage with pulse period $F_O$ is applied to solenoid 56 of pump 30 for impression time W preset in step 106 or 108. Thus, pump 30 is driven under these conditions.

If the engine is determined to be in the complete detonation state in step 98, step 100 is entered, as mentioned before. In step 100, whether or not the current value in subtraction counter Dc is 0 sec is determined. In other words, whether or not the engine has been in the complete detonation state for 5 sec or more is determined in step 100. If $Dc \neq 0$ sec is detected in step 100, step 108 is entered; if $Dc = 0$ sec, then step 112.

In step 112, as in step 108, impression time W for the pulse voltage applied to solenoid 56 of fuel resupply pump 30 is adjusted to 25 mssec, and step 114 is entered.

Figure 5:
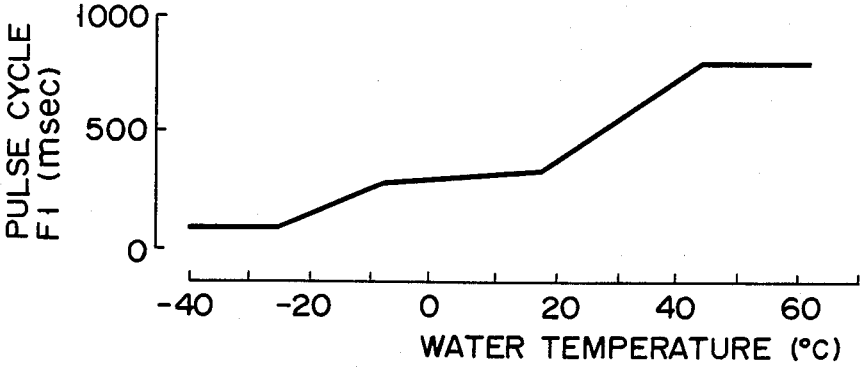

In step 114, pulse period F of the pulse voltage applied to solenoid 56 of fuel resupply pump 30 is adjusted to optimum period $F_1$ for complete detonation of the engine. Pulse period $F_1$ is obtained with use of the the cooling water temperature of the engine as a parameter, as shown in FIG. 5, and is also mapped and stored in memory 64 of microcomputer 60. Thus, in microcomputer 60, optimum period $F_1$ for complete detonation is determined in accordance with water temperature signal T inputted in step 92. In this case, therefore, a pulse voltage with pulse period $F_1$ is applied to solenoid 56 of pump 30 for impression time W of 25 msec, and pump 30 is driven under these conditions.

As shown in FIG. 2A, either of steps 110 and 114 is followed by step 116. In step 116 whether or not pulse period F for the drive of fuel resupply pump 30 is shorter than 400 msec is determined. If period F is determined to be not shorter than 400 msec in step 116, step 96 is entered. In step 96, the drive of pump 30 is stopped. If period F is longer than 400 msec, the cooling water temperature of the engine is about 20° C. or more, as shown in FIGS. 3 and 5. In this case, therefore, the combustion chambers of the engine should not be considered to require fuel supply any more. Moreover, even though pump 30 is driven with a period of 400 msec or more, the supply of the auxiliary fuel to intake passage 14 of carburetor 10 is practically negligible. Therefore, the drive of pump 30 can be stopped without hindrance.

If pulse period F is determined to be shorter than 400 msec in step 116, on the other hand, it is concluded that the cooling water of the engine is at a low temperature such that the complete detonation state of the engine must be maintained through the supply of the auxiliary fuel, and step 118 is entered. In step 118 fuel resupply pump 30 continues to be driven under the predetermined driving conditions.

Figure 2B:
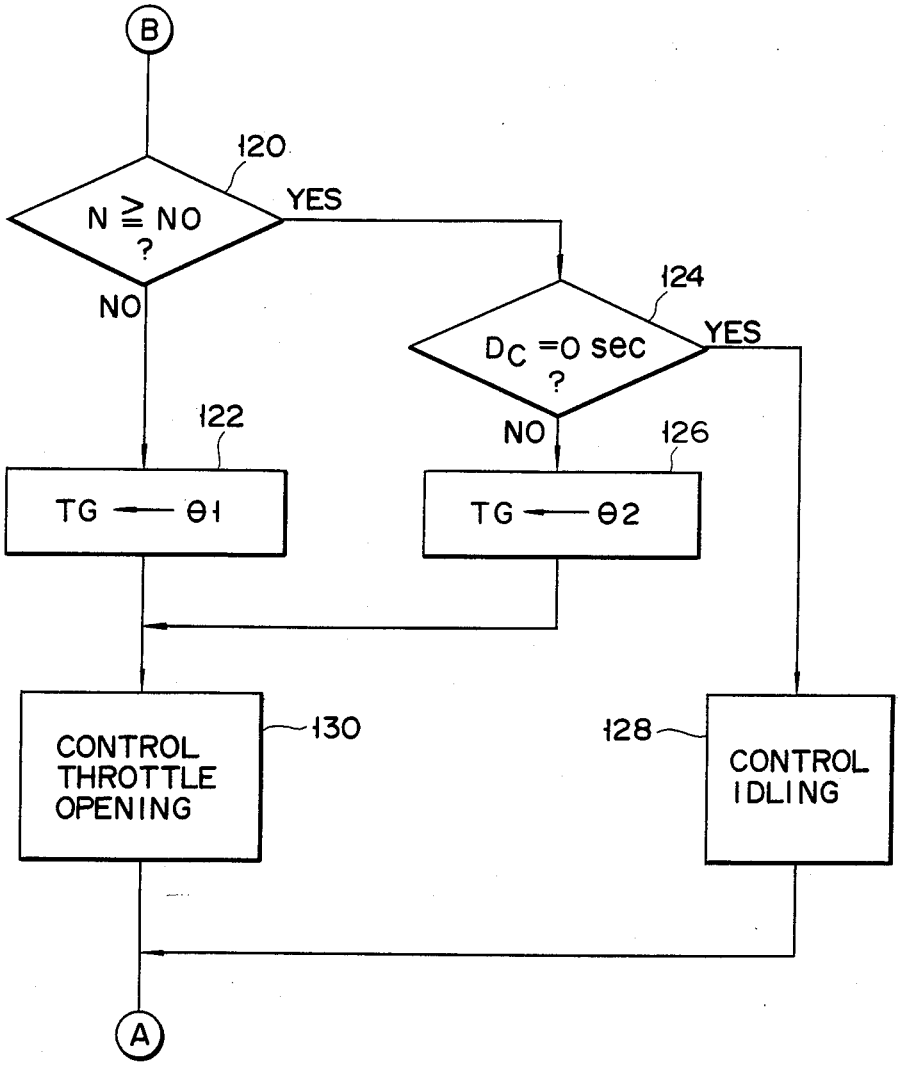
Figure 7:
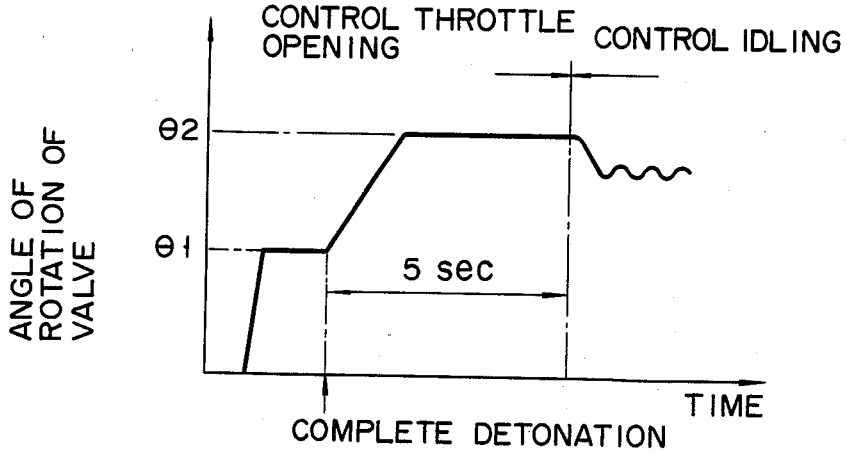
FIG. 7 is a diagram for illustrating the opening control of a throttle valve.

As shown in FIG. 2B, step 118 is followed by step 120. In step 120, as in step 98, whether or not the level of rotation signal N of the engine is not less than complete-detonation reference value $N_O$is determined. If it is concluded in step 120 that the level of rotation signal N is less than reference value $N_O$, step 122 is entered. If the level of signal N is found to be not less than value $N_O$, step 124 is entered. In step 122, angle $\theta_1$ is set as target opening TG of throttle valve 70 used when the engine is not in the complete detonation state. For example, angle $\theta_1$ is 5 degrees. In step 124, as in step 100, whether or not the current value in subtraction counter Dc is 0 sec is determined. If Dc≠0 sec is detected in step 124, that is, if it is concluded that the engine has been in the complete detonation state for less than 5 sec, step 126 is entered. If it is concluded in step 124 that the engine has been in the complete detonation state for 5 sec or more, step 128 in entered. In step 126, angle $\theta_2$ is set as target opening TG of throttle valve 70. Angle $\theta_2$ is preset in accordance with the fast idling speed of the engine. As shown in FIG. 7, angles $\theta_1$ and $\theta_2$ have a relationship $\theta_1 < \theta_2$.

Either of steps 122 and 126 is followed by step 130. In step 130, regulator 78 is controlled so that the difference between value $\theta$ of target opening TG of throttle valve 70 set in step 122 or 126 and actual opening $\theta_a$ of valve 70 is within a predetermined allowable range. Thus, the control signal is delivered from output interface 66 of microcomputer 60 to driver 90, thereby starting DC motor 88. As motor 88 rotates, nut member 86 makes a telescopic action. Accordingly, valve 70 is operated by means of rocking arm 80 so that value $\theta$ of target opening TG set in step 122 or 126 is reached practically.

If it is concluded in step 124 that the engine has been in the complete detonation state for 5 sec or more, step 128 is entered, as mentioned before. In step 128, regulator 78 is controlled to adjust the opening of throttle valve 70 so that the rotational frequency of the engine reaches a target idling speed previously set according to the cooling water temperature, on-off state of an air conditioner, and other conditions.

As shown in FIG. 2A, step 92 is resumed after step 128 or 130. As long as an ignition switch is on, the above-mentioned processes are repeated.

Figure 8:
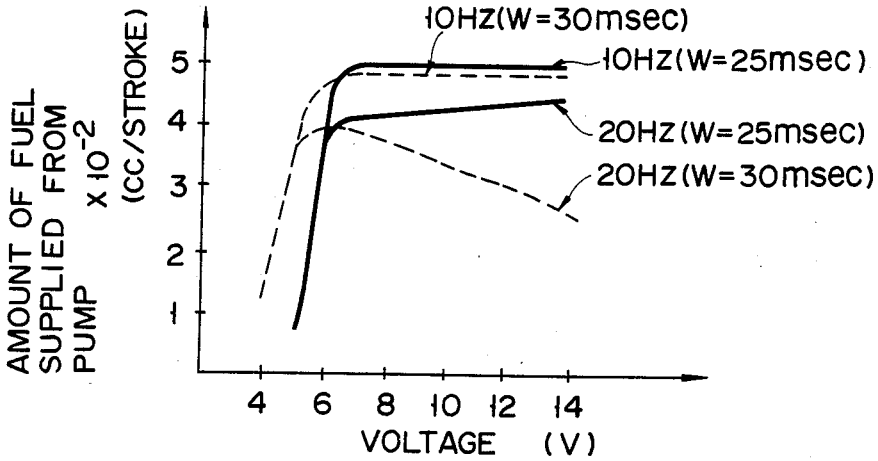
FIG. 8 is a diagram showing variations of the relationship between a pulse voltage applied to a fuel resupply pump and the discharge of the pump, depending on the impression time for the pulse voltage.

According to the starting system of the present invention, whether or not the engine is in the cranking state, in which it is externally driven by the starting motor, is determined in step 104. If the cranking state is detected, impression time W for the pulse voltage applied to solenoid 56 of fuel resupply pump 30 is adjusted to 30 msec in step 106. If the cranking state is not detected in step 104, step 108 is entered. In step 108, time W is adjusted to 25 msec. Also when the engine is already in the complete detonation state, impression time W is adjusted to 25 msec, as seen from the flow from step 100 to step 108 or 112. Namely, time W is extended only when the engine is in the cranking state. When the engine is in the cranking state, therefore, a sufficient discharge of the auxiliary fuel from fuel resupply pump 30 can be maintained by extending time W from 25 msec to 30 sec, even if the pulse voltage applied to solenoid 56 of pump 30 is lowered by a drop of battery voltage due to the drive of the starting motor. In FIG. 8, broken-line characteristic curves show the relationships between the fuel discharge of pump 30 and the pulse voltage obtained when impression time W is 30 msec. As seen from FIG. 8, the threshold value of the pulse voltage to cause a sudden reduction of the discharge of pump 30 is lower when time W is 30 msec than when it is 25 msec. Thus, by extending the impression time, the performance of pump 30 can be maintained despite a voltage drop.

As is evident from FIG. 8, moreover, if a sufficiently high pulse voltage is applied for 30 msec, the discharge of fuel resupply pump 30 is reduced. In the embodiment described above, however, impression time W for the pulse voltage applied to pump 30 is extended only when the engine is in the cranking state which involves a drop of battery voltage. This prevents the reduction of the discharge. According to the starting system of the present invention, therefore, a necessary quantity of auxiliary fuel can be supplied securely, whether the engine is in the cranking state or any other operating state. Thus, it is possible to positively improve the operating efficiency of the engine as well as its starting performance.

The optimum period of the pulse voltage for the cranking state is determined in step 110, and that for the complete detonation state in step 114. Accordingly, the engine can quickly shift from cranking state to complete detonation state, thus enjoying further improved starting performance.

If the engine is in the cranking state, the target opening of throttle valve 70 is adjusted to $\theta_1$ in step 122. If the engine is subject to unstable complete detonation, the throttle opening is adjusted to $\theta_2$ in step 126. Thereafter, in step 130, the opening of valve 70 is adjusted to preset target opening $\theta$ by actuating regulator 78. Enjoying the throttle opening control in this manner, the engine can be started and warmed up more efficiently than in the case where only the quantity of auxiliary fuel from fuel resupply pump 30 is controlled.

In step 128, moreover, the opening of throttle valve 70 is adjusted to an angle corresponding to the fast idling speed of the engine which depends on the load conditions, if the complete detonation state is stabilized. Thus, the engine can be prevented from stalling while it is idling.

The starting system of the present invention is not limited to the embodiment described above. In the above embodiment, for example, the drive of fuel resupply pump 30 is stopped in step 96 if the engine is found to be stopped in step 94. Alternatively, however, the pump may be driven before the start of the engine, e.g., during the period between the activation of the ignition switch and the actuation of the starting motor.

What is claimed is:

1. A starting system of an internal combustion engine adapted to be started by a starting motor, comprising:

a carburetor housing having an air intake passage;

a drive means for generating electric pulses of varying voltages, widths and periods, wherein the voltage of the pulses is relatively lower when said engine is in a cranking state;

an electromagnetically operated fuel resupply pump that is electrically connected to and powered by the electric pulses generated by the drive means for feeding auxiliary fuel to the intake passage of the carburetor housing, wherein the output of the pump is dependent upon the pulse voltage, the pulse width and the pulse period, and control means for controlling the drive of the fuel resupply pump by the drive means, said control means including a period decision circuit for determining the period of the pulse voltage applied to the pump, and a pulse width correction circuit for lengthening the impression time for the pulse voltage applied to the pump when the engine is in a cranking state so that the fuel output of the fuel resupply pump is sufficient to start the engine despite the lower pulse voltage associated with the cranking state of the engine.

2. A starting system of an internal combustion engine adapted to be started by a starting motor, comprising:

a carburetor housing having an air intake passage defined inside;

an electromagnetically operated fuel resupply pump for feeding auxiliary fuel into the intake passage of the carburetor housing, said fuel resupply pump including a plunger in cooperation with a return spring, and adapted to effect a pumping function such that the plunger is reciprocated for one stroke every time a pulse voltage is applied to the solenold for a predetermined impression time, and wherein the output of the pump is dependent upon the pulse voltage, the pulse width and the pulse period;

operating state detecting means for determining whether the engine is stopped, or in a cranking state, or in a complete detonation state such that the engine can maintain its rotation for itself;

drive means for driving the fuel resupply pump by applying a pulse voltage with a predetermined period to the solenoid of the pump for a predetermined impression time, wherein the pulse voltage applied by the drive means is relatively lower when said engine is in a cranking state; and control means for controlling the drive of the fuel resupply pump by the drive means, said control means including a period decision circuit for determining the period of the pulse voltage applied to the solenid of the pump, in accordance with the operating state of the engine detected by the operating state detecting means, and a pulse width correction circuit for lengthening the impression time for the pulse voltage applied to the solenoid of the fuel resupply pump when the engine is in the cranking state so that the fuel output of the fuel resupply pump is sufficient to start the engine despite the lower pulse voltage associated with the cranking state of the engine.

3. The starting system according to claim 1, wherein said operating state detecting means includes a detector for detecting the rotational frequency of the engine, a detector for detecting the temperature of cooling water of the engine, and a detector for detecting the drive of the starting motor.

4. The starting system according to claim 2, further comprising a throttle valve disposed in the intake passage of the carburetor housing and adapted to open and close the intake passage, and regulating means for adjusting the opening of the throttle valve in accordance with the operating state of the engine.

5. The starting system according to claim 4, wherein said regulating means includes a regulating circuit adapted to adjust the throttle valve to a first opening when the engine is in the cranking state, and to adjust the valve to a second opening greater than the first opening when the engine is in an unstable complete detonation state.

6. The starting system according to claim 5, wherein said regulating circuit includes an actuator for actuating the throttle valve, said actuator having a DC motor and converter means for converting the rotation of the motor into an action of the throttle valve.

7. The starting system according to claim 5, wherein said regulating means includes a second regulating circuit for adjusting the opening of the throttle valve in accordance with the load condition of the engine when the engine is in a stable complete detonation state.

8. The starting system according to claim 7, wherein said second regulating circuit adjusts the opening of the throttle valve so that the engine is in a fast idling state.

9. A starting system of an internal combustion engine adapted to be started by a starting motor, comprising:

a carburetor housing having an air intake passage defined inside;

a throttle valve disposed in the intake passage of the carburetor housing and adapted to open and close the intake passage, and regulating means for adjusting the opening of the throttle valve in accordance with the operating state of the engine wherein said regulating mans includes a regulating circuit adapted to adjust the throttle valve to a first opening when the engine is in the cranking state, and to adjust the valve to a second opening greater than the first opening when the engine is in an unstable complete detonation state;

an electromagnetically operated fuel resupply pump for feeding auxiliary fuel into the intake passage of the carburetor housing, said fuel resupply pump including a plunger and a solenoid for reciprocating the plunger in cooperation with a return spring, and adapted to effect a pumping function such that the plunger is reciprocated for one stroke every time a pulse voltage is applied to the solenoid for a predetermined impression time;

operating state detecting means for determining whether the engine is stopped, or in a cranking state, or in a complete detonation state such that the engine can maintain its rotation for itself;

drive means for driving the fuel resupply pump by applying a pulse voltage with a predetermined period to the solenoid of the pump for a predetermined impression time; and control means for controlling the drive of the fuel resupply pump by the drive means, said control means including a period decision circuit for determining the period of the pulse voltage applied to the solenoid of the pump, in accordance with the operating state of the engine detected by the operating state detecting means, and a pulse width correction circuit for a correction such that the impression time for the pulse voltage applied to the solenoid of the fuel resupply pump is longer when the engine is in the cranking state than when the engine is in any other operating state.

* * * * *